United States Patent [19]

Büyükgüclü e of Patent:

[11] Patent Number: 4,833,501

May 23, 1989

[54] APPARATUS AND METHOD FOR FILLING A TONER RESERVOIR BY SUCTION

[75] Inventor: Mehmet Ali Büyükgüclü, Munich, Fed. Rep. of Germany

[73] Assignee: Siemens Aktiengesellschaft, Berlin and Munich, Fed. Rep. of Germany

[21] Appl. No.: 17,980

[22] Filed: Feb. 24, 1987

[30] Foreign Application Priority Data

Mar. 14, 1986 [DE] Fed. Rep. of Germany ..... 3608605

[51] Int. Cl.[4] ..... G03G 15/00; G03G 15/08

[52] U.S. Cl. ..... 355/3 R; 222/DIG. 1; 355/245

[58] Field of Search ..... 355/3 DD, 3 R, 15, 14 R, 355/14 D; 222/DIG. 1, 630, 416; 406/151, 171, 168; 55/467

[56] References Cited

U.S. PATENT DOCUMENTS

| | | | |
|---|---|---|---|
| 2,812,217 | 11/1957 | Koch et al. | 406/171 |
| 3,951,539 | 4/1976 | Draugelis | 355/3 DD |
| 3,958,878 | 5/1976 | Smith et al. | 355/3 DD X |
| 4,029,047 | 6/1977 | Bell | 118/652 |
| 4,274,455 | 6/1981 | Simons | 141/1 |
| 4,561,759 | 12/1985 | Knott | 355/3 DD |

FOREIGN PATENT DOCUMENTS

| | | | |
|---|---|---|---|
| 3240 | 1/1978 | Japan | 355/14 D |
| 37925 | 4/1981 | Japan | 406/151 |
| 120376 | 6/1985 | Japan | 355/3 DD |
| 59464 | 3/1986 | Japan | 355/3 DD |
| 246778 | 11/1986 | Japan | 355/3 DD |
| 2065617 | 7/1981 | United Kingdom . | |

OTHER PUBLICATIONS

Japanese Patent Abstracts, vol. 3, No. 94 (E-129), published Aug. 10, 1979, Application No. 52-139408.

IBM Technical Disclosure Bulletin, vol. 22, No. 5, published Oct., 1979, "Replacing a Toner Return Auger System by an Ejector".

Xerox Disclosure Journal, "Pneumatic Toner Conveying System", vol. 1, No. 8, Aug. 1976, by Daniel J. Harmon.

*Primary Examiner*—Arthur T. Grimley
*Assistant Examiner*—Edward Pipala
*Attorney, Agent, or Firm*—Hill, Van Santen, Steadman & Simpson

[57] ABSTRACT

An apparatus is provided for filling toner from a transport container into a toner reservoir from where the toner is then supplied to a developing station of an electro-photographic printer or copying device contains a toner reservoir which is divided into a settling space and into a suction space. The settling space and the suction space are separated via a filter. For transferring the toner from a transport container into the toner reservoir, the transport container is connected to the settling space via a flexible line. An evacuation pump connected to the suction space generates an underpressure, whereby the toner settles on the filter means of the settling space. A metering device situated at the floor of the settling space conveys the toner to the developing station.

10 Claims, 2 Drawing Sheets

APPARATUS AND METHOD FOR FILLING A TONER RESERVOIR BY SUCTION

BACKGROUND OF THE INVENTION

1. Field of the Invention

The invention is directed to an apparatus for filling toner from a transport container into a toner reservoir from which the toner is then supplied to a developing station of an electro-photgraphic printer copying device.

2. Description of the Prior Art

In copier technology and in modern high-speed data printers which operate on the principle of electrophotography, charge images are generated on a recording medium, for example directly onto an intermediate carrier (photoconductive drum) or directly on special paper, and are subsequently inked in a developing station with a black powder (toner). Given employment of an intermediate carrier, this toner image is subsequently transferred onto normal paper and is fixed thereon. As a rule, a two-component developer is employed for developing, this being composed of ferro-magnetic carrier particles and of toner particles. The developer is conducted past the charge image on the intermediate carrier by means of a magnetic brush arrangement, the toner remaining adhering to the intermediate carrier due to electrostatic forces.

An electro-photographic copier device which develops charge images based on the specified principle is disclosed, for example, by German AS No. 21 66 667.

Due to the inking of the charge images on the intermediate carrier, the toner concentration in the developer mix of the developing station constantly decreases. It is therefore necessary to constantly supply new toner to the developer mix in metered fashion. Since the toner consumption per time unit is extemely high in fast copier devices and high-speed data printers, a spacious toner reservoir is employed in such devices in order to avoid standstill times due to refilling of toner. When this toner reservoir is empty, the toner, which is usually supplied in hand containers, is filled into the reservoir. It is thereby important to fill the toner from the container into the reservoir such that no toner is spilled which would thereby contaminate the environment.

German Pat. No. 32 34 296 discloses an apparatus for filling and sieving toner from a container into a toner reservoir. The toner situated in a transport container, namely a toner bottle, is thereby supplied to a reservoir in that the toner bottle is inverted into a filling opening of the reservoir. A strainer basket closed toward the reservoir with a sieve is arranged in the region of the filling opening, this straining basket being in communication with an electrical shaking means triggerable as needed. The shaking means is thereby initiated by opening the cover closing the filling opening.

Given such filling apparatus, the risk then exists that toner will be spilled given manual transfer from the toner bottle. Since, moreover, the toner is supplied to the toner reservoir at only one defined location, special distributing devices in the toner reservoir are necessary in order to guarantee a uniform feed of the toner to the developing station.

SUMMARY OF THE INVENTION

An object of the invention is to fashion an apparatus of the type described above such that the toner can be transferred from a simple, cost-favorable transport container into a reservoir at the apparatus side having a high capacity without toner cakings occuring or having toner spilled.

This object is achieved in an apparatus of the type described.

In an advantageous way, the toner is removed from a transport container, namely the toner bottle, in the invention via a flexible line by means of underpressure by suction. Via the flexible line, the toner proceeds into a reservoir which is divided into a settling space and into a suction space separate from the settling space. The suction space is in communication with an evaculation pump which generates an underpressure, whereby the toner settles on the filter of the settling space. After the evacuation pump is disconnected, the toner falls onto a conveyor worm arranged at the floor of the settling space, this conveyor worm supplying the toner to the developing station of the printer in metered fashion.

A uniform distribution of the toner in the reservoir is derived by employing a pressure distribution plate including a plurality of openings. The toner thereby settles at the locations of the filter at which a high flow occurs, whereby more toner initially settles at these locations than at locations having less flow. Due to the thicker toner layer, however, the flow resistance then increases, so that the flow is now displaced. This procedure is repeated until a defined layer thickness of toner is reached; the toner particles then fall into the region of the metering device.

Clumping of the toner cannot occur since the toner is not mechanically compressed.

As a result of the flexible hose, the transport container, namely the toner bottle, is not restricted to a specific location and it can be connected or arranged in a service-friendly way. The toner reservoir itself contains no mechanically moving parts and can therefore be cost-favorably manufactured of thin-walled plastic.

In an especially advantageous embodiment of the invention, a combined holding and shaking means accepting the transport container is provided, this holding and shaking means being pivotably arranged at the apparatus. Upon insertion of the toner bottle in a first acceptance position of the holding means and after connection of the bottle to the flexible line, the transport container is pivoted up in a simple way and, thereafter, the shaking means, which is arranged in the pivot region of the holding means, and the evacuation pump are initiated.

The apparatus can thereby remain optionally switched on until the bottle is empty, or it can be switched on as needed when only a predetermined residual quantity in the reservoir remains. The transport container, namely the toner bottle, can thus itself serve as additional reservoir in addition to the actual reservoir, wherewith the toner reservoir itself can be designed smaller.

BRIEF DESCRIPTION OF THE DRAWINGS

Embodiments of the invention are shown in the drawing and shall be set forth in greater detail below by way of example. Shown are.

DESCRIPTION OF THE PREFERRED EMBODIMENTS

Figure 1:
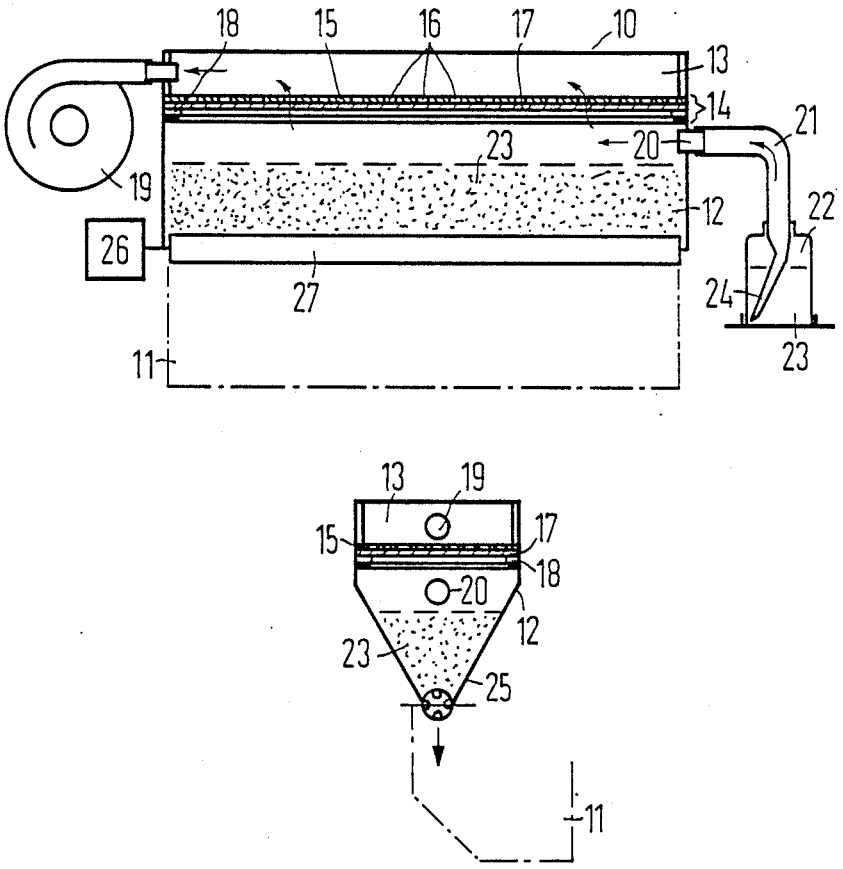
FIG. 1 is a schematic illustration of an apparatus for filling toner from a transport container into a toner reservoir, shown partially in a sectional view.

A toner reservoir 10 from which toner is supplied to a developing station 11 for developing charge images is situated in a non-mechanical fast printer (laser printer) which is not shown here. The toner reservoir 10 has roughly the width of the developing station 11, this roughly corresponding to the printing width, and is divided into a settling space 12 and a suction space 13. The spaces are separated from one another by a filter means 14. The filter means 14 is closed relative to the suction space 13 by a pressure distributor plate 15 having a plurality of openings 16 arranged therethrough. The actual, toner-tight filter 17 which, for example, can be composed of a glass mat is situated on the pressure distributing plate 15. This filter 17 is sealed at its edges by strips 18 of cellular material. The pressure distributing plate can also be composed of a simple supporting grid. The openings 16 can thereby be arranged and dimensioned in accord with the desired pressure distribution.

The suction space 13 is in communication with an electromotively operated evacuation pump 19. The settling space 12 in turn has a connecting branch 20 to which a flexible tube conduit 21 in the form of a suction hose is connected.

For transferring toner 23 supplied in toner bottles 22 into the toner reservoir 10 or, respectively, into the developing station 11, the flexible, nose-shaped suction line 21 has its suction nozzle 24 introduced into the toner bottle 22 and the evacuation pump 19 is then actuated. The underpressure generated in the suction space 13 which acts uniformly over the openings 16 of the pressure distributing plate 15 generates a corresponding underpressure in the settling space 12, whereby the toner 23 is sucked into the settling space 12 in accord with the "vacuum cleaner principle". The toner settles under the filter means 14, namely uniformly over the full width of the toner reservoir.

This is automatically effected in that a great flow occurs at the locations of the filter due to larger openings 16 or increased transmissivity of the filter 17, so that more toner 23 initially settles at these locations than at other locations having less flow. Due to the arising, thicker toner layer, however, the flow resistance at the former locations becomes greater, this in turn leading to a retardation of the settling process at those points wherewith the latter locations in turn receive a greater flow. As a result thereof, the toner particles settle more intensely at these latter locations. This procedure is repeated until a defined toner layer thickness is reached. The toner particles then fall into the lower conically converging region 25 of the settling space. So that further suctioning of the toner 23 is not impeded, the connecting branch 20 for the flexible conduit is therefore arranged in the upper part of the conical region of the settling space 25. A meter device in the form of a conveyor worm 27 driven via a motor 26 is arranged at the lower region 25 of the conically fashioned settling space 12. This worm conveys toner to the developing station 11 as needed dependent on a filling level measuring means which is not shown.

Figure 2:
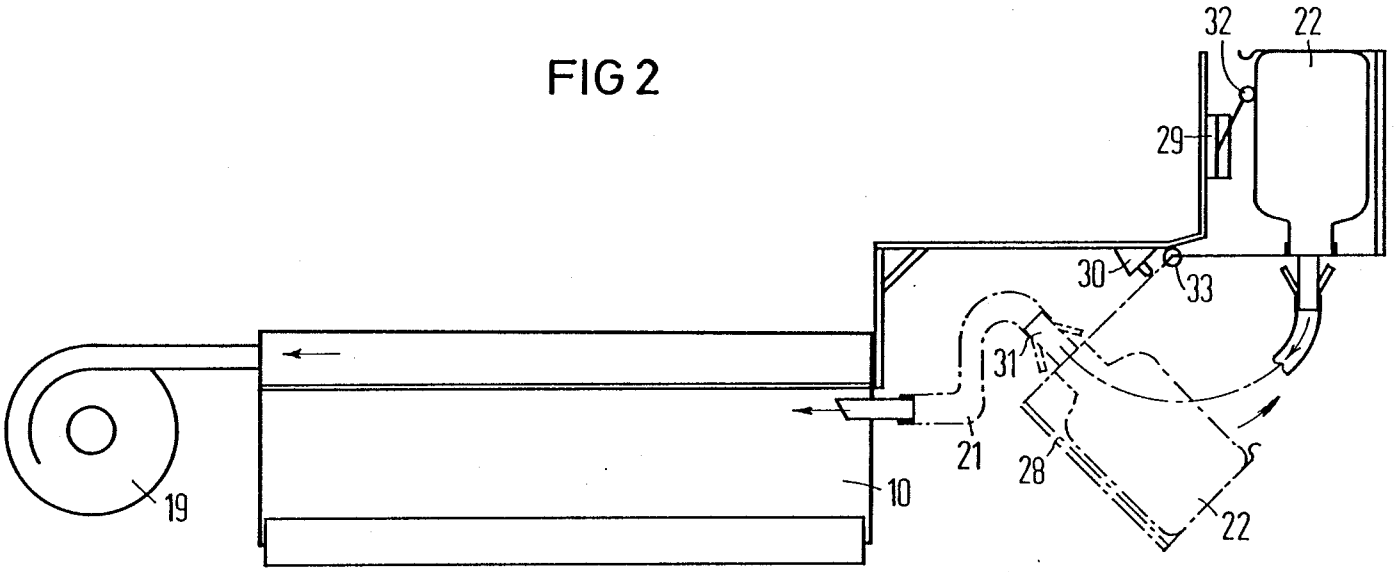
FIG. 2 is a schematic illustration of the same apparatus with a combined holding and shaking means accepting the transport container.

In an especially advantageous embodiment of the invention shown in FIG. 2, a combined holding and shaking device is situated at the toner reservoir 10. This device is composed of a holding device 28 pivotably arranged at the device for the acceptance of the toner bottle 22. A shaking device 29 is situated in the pivot region of the holding device 28. A switch 30 which senses the position of the holding device 28 is also provided.

In order to replenish the toner supply in the toner reservoir, the toner bottle 22 is located in the holding device 28 in the pivoted-out condition of the holding device as shown in broken lines. The toner bottle is then connected bayonet-like with a closure (not shown) having a correspondingly fashioned suction nozzle 31, being connected to the flexible line 21. The switch 30 actuating the evacuation pump 19 is thereby interrupted. After the holding device 28 is pivoted up in arrow direction, the bottle proceeds into the region of influence of the shaking device 29. The switch 30 can then be coupled such with the shaking device 29 or, respectively, with the evacuation pump 19 that the evacuation pump 19 and the shaking device 29 are automatically switched on when the bottle is pivoted up. The toner bottle 22 is shaken via a swipe 32 which is electromotively operated. However, the shaking device can also be fashioned in accord with German Pat. No. 32 24 296.

A fast, residue-free emptying of the bottle is achieved by the shaking.

The apparatus can optionally remain switched on until the toner bottle 22 becomes empty, for example, less than one minute is required for a 1 Kg bottle or it can be switched on as needed. This activation can be undertaken dependent on the downward transgression of a defined residual quantity in the reservoir. The toner bottle 22 thereby serves as an additional reservoir for the toner reservoir 10.

The toner reservoir 10 itself can be completely manufactured of plastic. The holding device together with the hinge 33 connecting it to the housing of the apparatus can be manufactured of metal.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An apparatus for filling toner from a transport container into a toner reservoir from which the toner is then supplied to a developing station of an electrophotographic printer or copier device, comprising a toner reservoir including a settling space which is in communication with the developing station and including a suction space separated from the settling space via a filter means and having an allocated apparatus generating an underpressure, wherein the transport container is connected to the settling space via feed line for transferring the toner out of the transport container so that the toner then settles in the settling space by generating an underpressure in the suction space.

2. An apparatus according to claim 1, wherein a metering means supplying the toner to the developing station is positioned at the floor of the settling space.

3. An apparatus according to claim 1, wherein the filter means comprises a pressure distributing plate having a plurality of openings and a filter mat.

4. An apparatus according to claim 1, wherein the settling space is constructed such that, at least given interruption of the underpressure generation, the toner settles in the region of the metering device.

5. An apparatus according to claim 2, wherein the metering device comprises a conveyor worm.

6. An apparatus according to claim 1, wherein the suction space is in communication with an evacuation pump.

7. An apparatus according to claim 1, wherein a holding and shaking device accepts the transporting container.

8. An apparatus according to claim 7, wherein the holding device is pivotably arranged at the apparatus, whereby the transport container is insertable into the holding device in a first acceptance position thereof and is connectable to the toner reservoir with a flexible line; and in that, after pivoting the holding device into the range of influence of the shaking device, at least one of the shaking device and the means generating the underpressure are activatable via appropriate switch means.

9. An apparatus according to claim 8, wherein said switch means is arranged in the range of pivot of the holding device.

10. A method for filling toner from a transport container into a toner reservoir from where the toner is then supplied to a developing station of an electrophotographic printer or copier device, comprising the steps:

(a) suctioning the toner out of the transport container with the assistance of underpressure and depositing the toner at a filter means in the toner reservoir; and (b) supplying the toner deposited at the filter means to the developing station via a metering means.

* * * * *